US005427048A

United States Patent [19]

Takeuchi

[11] Patent Number: 5,427,048

[45] Date of Patent: Jun. 27, 1995

[54] MULTI-CONCAVE HYDRODYNAMICALLY DESIGNED HULL

[76] Inventor: Richard T. Takeuchi, 3518 Harding Ave., Honolulu, Hi. 96816

[21] Appl. No.: 203,390

[22] Filed: Mar. 1, 1994

[51] Int. Cl.[6] ..... B63B 1/16

[52] U.S. Cl. ..... 114/288; 114/62

[58] Field of Search ..... 114/62, 271, 288, 290, 114/56, 67 A

[56] References Cited

U.S. PATENT DOCUMENTS

| | | | |
|---|---|---|---|
| 597,195 | 1/1898 | Evesson | 114/62 |
| 2,285,959 | 6/1942 | Dubay | 114/288 |
| 2,373,019 | 4/1945 | Dix | 114/288 |
| 3,726,246 | 4/1973 | Wukowitz | 114/67 A |
| 4,922,844 | 5/1990 | Solia | 114/62 X |

*Primary Examiner*—Sherman Basinger
*Attorney, Agent, or Firm*—Michael I. Kroll

[57] ABSTRACT

The present invention relates to a hydrodynamically designed concave hull having longitudinally positioned chined rails at the outermost edges of the concave scoops. Each pair of concave scoops have a central longitudinally positioned median V-shaped groove to channel water and facilitate steering of the hull.

3 Claims, 2 Drawing Sheets

MULTI-CONCAVE HYDRODYNAMICALLY DESIGNED HULL

BACKGROUND OF THE INVENTION

1. Field of the Invention

The present invention relates to a hydrodynamically designed hull.

More particularly, the present invention relates to a hydrodynamically designed hull with hydrofoil qualities.

2. Description of the Prior Art

The invention pertains to an aquatic planing hull which is uniquely configured and has attributes which boat hulls of previous design have not been able to attain. While the prior art has recognized to a certain extent the desirability of having hull designs to achieve end results, the hull design of this invention provides a water craft which has relatively small draft and which has low frictional drag characteristics so as to provide high speed and stable performance.

The hull of the instant invention permits relatively shallow draft with a relatively long hull length and a relatively wide hull beam, all while achieving high water velocities, which would not normally be expected considering the conventional power needs of a similarly-sized hull.

Water craft using the hull design of the instant invention will be capable of high speeds, will use significantly less power than other craft of its size and type and because of its unique configuration will require, in the ordinary case, low draft requirements. The hull design permits unusually high maneuverable characteristics and stable performance at high speeds and also allows the craft to turn within its own length.

The hull design also permits the craft to ride relatively high in the water thereby leaving a minimum amount of surface to be wetted by the water so as to decrease the amount of frictional drag created by the hull, as the water craft is being propelled through a body of water.

In the hull of the instant invention, the open concave forward portion of the hull is such that a cushion of air and water is provided, such that the main body of water that the craft is moving through will break at the main keel portion of the hull, which is located rearward of the mid-point.

Because these is a great need for water craft capable of high speeds, many alternative vehicle concepts have been developed in attempts to evade the problem of pounding. Some of these prior art developments are the surface piercing hydrofoils, fully submerged hydrofoils, air cushion vehicles, captured air bubble craft, super critical displacement hulls and submarines. It would be inappropriate to analyze the characteristics of each of these vehicles here, but it should be noted that only submarines and fully submerged hydrofoils have clearly circumvented the pounding problem while all are much more complicated than a planing boat. This added complexity manifests itself in greatly increased first cost, decreased reliability and severe operation limitations of one kind or another.

The planing craft only planes on a small portion of its bottom at high speeds. When such a craft encounters a wave, the lifting area is greatly increased and the craft experiences the upward acceleration which is the most marked feature of pounding. Because of the inertia of the water in the wave, the magnitude of this acceleration is much greater and would be calculated simply from the increase in wetted area. Thus, the problem which exists is derived from the fact that most planing craft have planing surfaces which are much too large. Others have utilized the "deep V" in hull design in order to reduce pounding. Although, it is generally supposed that a deep V somehow cushions the impact, it actually reduces the efficiency of the lifting surface and hence, in effect, constitutes a reduction of the planing surface size for given boat size. Unfortunately, the deep V not only does not reduce the wetted area, but actually increases it thereby leading to higher skin friction drag.

Hydrofoils raise the hull of the boat up out of the water so that high speeds can be obtained but the hydrofoil is limited in rough sea operations by the distance the hull is raised out of the water. Thus, with waves above a certain size, the boat will be subjected to the same severe pounding that ordinary planing craft are subjected to.

Numerous innovations for aquatic planing hulls have been provided in the prior art that are adapted to be used. Even though these innovations may be suitable for the specific individual purposes to which they address, they would not be suitable for the purposes of the present invention as heretofore described.

SUMMARY OF THE INVENTION

While under way, the weight of a planing hull is supported by a combination of hydrostatic and dynamic force (lift). At slow speeds, the weight of displaced water supplies most of the force that keeps the boat afloat. For example, when a boat is doing 25 knots, about 90 percent of the force counteracting the vessel's weight comes from dynamic lift.

When a convex bottomed hull is moved in a forward direction, the shape of the hull has a tendency to cleave the water outwardly and in a upward direction, away from its longitudinal center. The bow waves and wash created by the convex hull, are part of its inherent by product of wasted energies.

The concaved and wedge shaped bottom of the boat is designed to utilize the forces that are created as the hull is moved in the forward direction. As the boat gains speed in the forward direction, the planing under side of the concavity direct the forces created in an outwardly and downward direction away from its longitudinal center. This forces the water within the concavity in a downwardly direction creating a pressure ridge along the longitudinal center of the concavity giving the hull greater lift.

The right angle forces that are created along the concavity's longitudinal center are also used on the inner sides of the wedge shaped bottom to propel it in the forward direction. The V-shape groove has been made along the bottom's longitudinal center, is there as a divider to equalize the forces on both sides of the concavity.

By utilizing the above mentioned forces in a semi-captive state, we are able to enjoy greater dynamic lift, speed and riding comfort.

This invention can be utilized by boats and ships of any size and shape, be it monohulls, catamarans, trihulls, swath and others propelled by sails or by any state of the art mechanical propulsion systems.

The present invention provides a high speed boat with a planing hull which is not subjected to pounding in waves but cuts through the waves, thereby giving the boat an amazingly steady level ride. The hull is not only efficient at high speed but has excellent seaworthiness at low speed due to its low natural frequencies in roll and pitch. At high speed, the hull is stabilized by spray sheets thrown up that contact the hull sides.

Accordingly, it is an object of the present invention to provide an aquatic planing hull.

More particularly, it is an object of the present invention to provide an aquatic planing hull which avoids the disadvantages of the prior art.

It is an object of the present invention to provide a hull which is capable of adaptation to water craft of various types.

It is another object of the present invention to provide a hull for water craft which requires little water depth in which to operate.

It is another, still more important object of the present invention to provide a hull which uses relatively little wetted surface.

It is another, still more important, specific object of the present invention to provide a hull which may be used with pleasure or military craft.

It is another, still more important object of the present invention to provide a hull for water craft which is of open-scoop design.

It is another, still more important object of the present invention to provide a hull with a unique configuration having a narrowing concave open scoop, fore portion extending into and merging with a rearward widening concave portion, wherein a central median V-shaped groove runs longitudinally between two concave scoops providing high velocity and stability to water craft.

It is another, still more important object of the present invention to provide a hull design utilizing an open-scoop configuration of concave, curvilinear configuration which extends from the approximately bow of the hull with a central grove to channel water increasing the stability and facilitate steering.

It is still another, still more important object of the present invention to provide a hull design which permits a water craft to be more rapidly powered through a body of water than conventional craft would be, using the same power source.

It is another, still more important object of the present invention to provide a hull for use with water craft wherein the water craft has low draft requirements, is of a relatively low wetted surface area to thereby achieve high velocity and wherein the craft rides high in the water under full power or at rest wherein the hull is relatively easily manufactured.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

DETAILED DESCRIPTION OF THE PREFERRED EMBODIMENT

Figure 1:
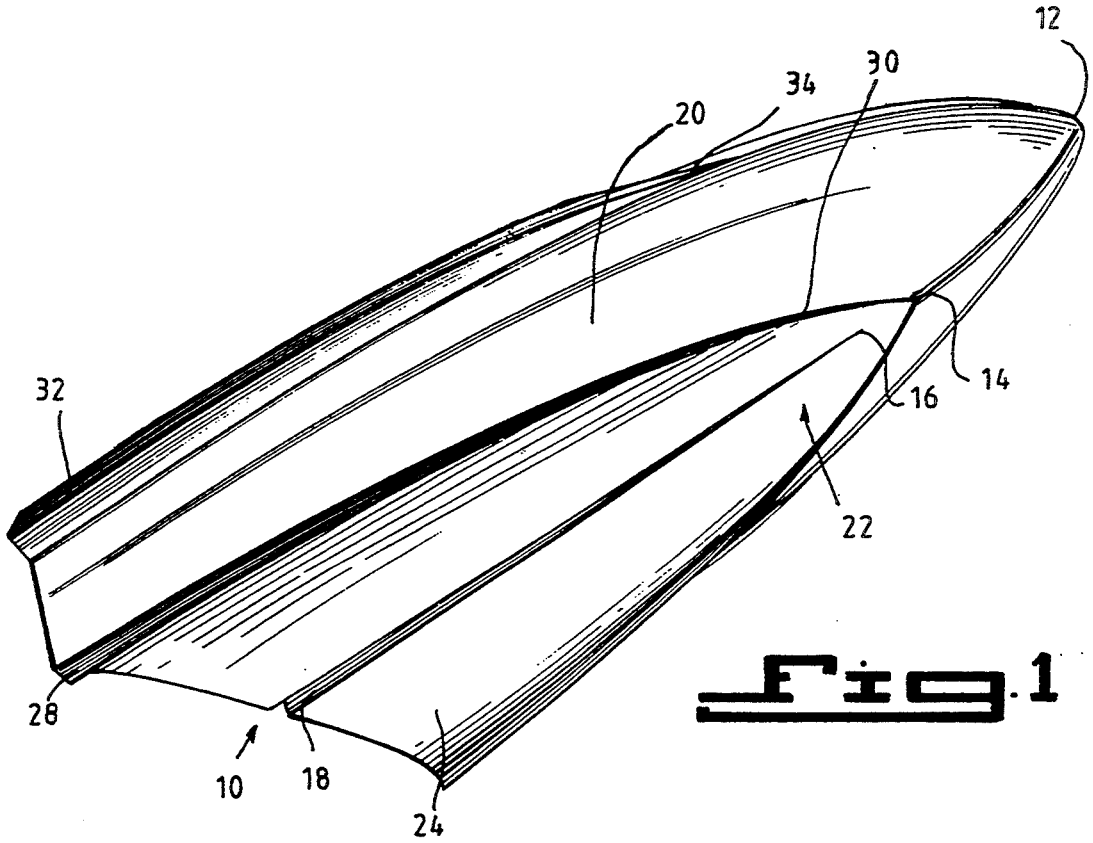
FIG. 1 is a perspective view of the concave hull with central hydrochannel.

Referring to FIGS. 1, 3, 4, 5, 6, and 7, the concave hull with central hydro channel 10 is supported by a combination of hydrostatic, lateral pressure 42 and dynamic force lift, ventricle pressure 44. The lateral pressure 42 releases water in a bi-directional direction. The water released from the lateral pressure 42 which is forced in the direction outwardly from the concave surface 24 comes in contact with the chined rail 28 that functions to cleanly and rapidly release the water, thus, increasing the speed of the hull. When the concave hull is moved in a forward direction, the shape of the hull cleaves the water outwardly due to lateral pressure 42 and in an upward direction due to ventricle pressure 44 away from longitudinal central axis.

The lateral pressure 42 which is forced in the direction toward a central axis is entrapped in the V-shaped groove 16 which channels water from the bow 12 of the hull toward the stern of the hull. This channelling of the water also functions as an inverted skeg or fin arrangement, thus, functioning as to guide the hull in a straightward direction. Since the inverted skeg or fin is not formed from a rigid material, turning the hull is facilitated due to the phenomenon of cavitation in which water bubbles are formed on the underside of the hull when the hull is turned. The water bubbles which are formed when the hull turns disrupt the inverted skeg or fin and the hull is easily turned. The ventricle pressure 44 is formed on the gunnel sides 20 of the hull when the hull slices through the water. The bow waves are first engaged by the top of the bow 12, bottom of the bow 14, along the gunnel 20. The ventricle pressure begins at the bow 12 which is the beginning of the convex shape of the hull. The ventricle pressure increases as the water engages the middle of the gunnel 20 which has minimal convex shape, thus terminating at the stern of the gunnel 20 of the hull which does not exhibit any convex shape. When the water is released due to ventricle pressure 44 the water forced in the direction upwardly on the gunnel 20 engages the upper chine 32 which functions to direct the water up and away from the gunnel. Hence, the water is cleanly sliced and hull speed increases. The combination of lateral pressure 42 functions to lift the hull while simultaneously the ventricle pressure 44 functions to slice and release the water from the hull. Both of these pressure acting concurrently increase the speed of the hull.

Figures 3, 4, 5, 6, 7:
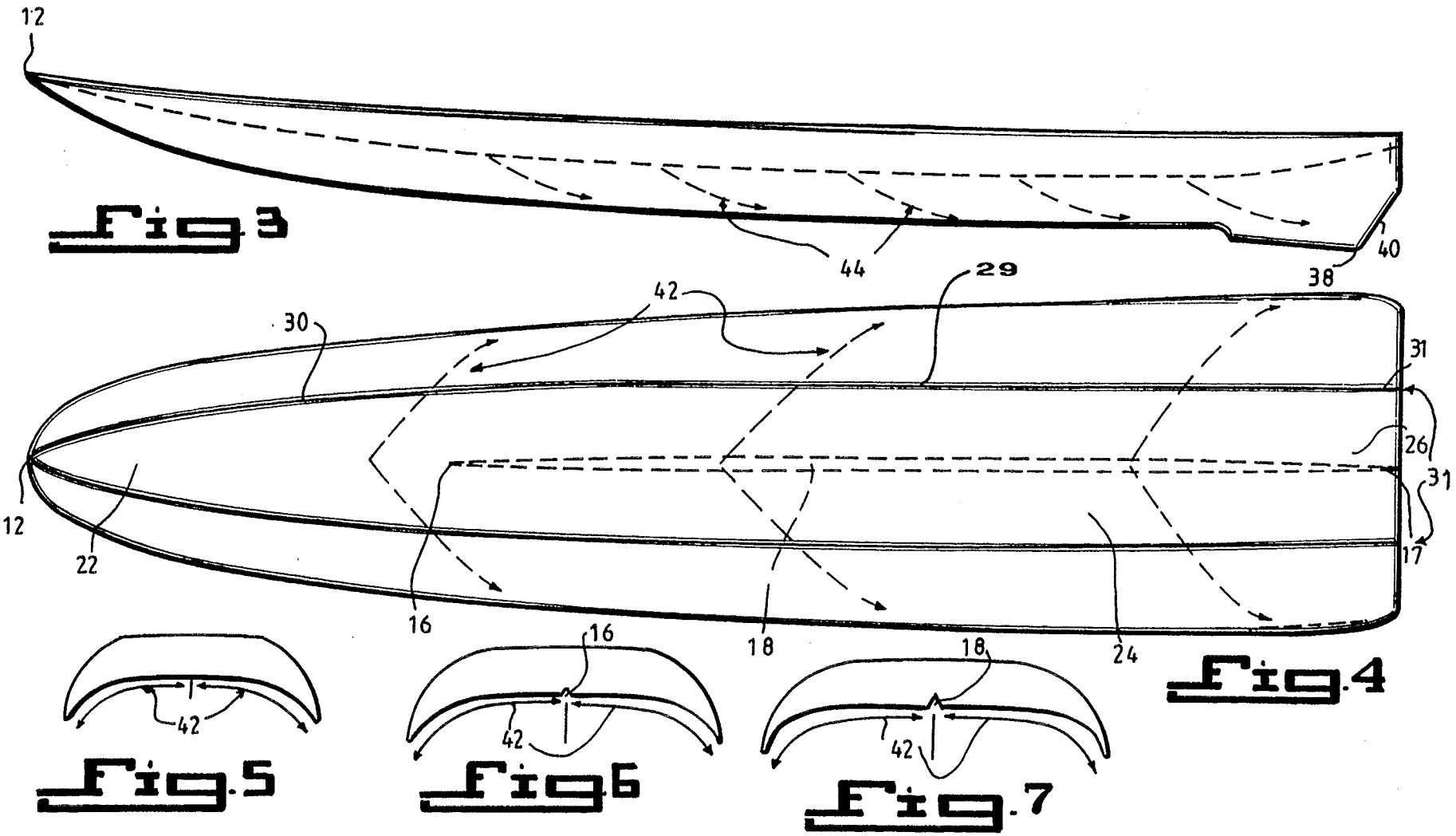
FIG. 3 is a side view of the concave hull exhibiting the stabilizer fin, stabilizer aileron and ventricle pressure.
FIG. 4 is a bottom view of the concave hull exhibiting the central hydrochannel and lateral pressure.
FIG. 5 is a cross sectional view of the fore end of the concave hull at a position in front of the fore end of the central hydrochannel.
FIG. 6 is a cross sectional view of the fore end of the concave hull exhibiting the fore end of the central hydrochannel.
FIG. 7 is a cross sectional view of the middle of the concave hull exhibiting the central hydrochannel.

Concurrently the pressure forces function to lift the concave hull 10 forcing the water and channeling it through the fore end 16, middle and rear end 17 of the V-shaped hydrochannel 18. As seen in FIG. 4, V-shaped hydrochannel 18 is tapered at both distal ends. The V-shaped hydrochannel 18 also functions as a divide to equalized the forces on both sides of the concavity. Further, the V-shaped channel 18 is composed of equal obtuse angles from the hull surface. The water also creates hydrodynamic lift, ventricle pressure 44 commencing at the fore end 22 terminating at the rear end 26 and top of concavitiy's inner liner with the greatest amount of ventricle pressure 44 at the middle section 24 of the concave hull 10.

A pair of longitudinally running lower obtusely angled chine rails 28 are positioned at the outermost position of the concave hull. The lower chines are composed of a fore end 30, middle 29, and rear end of lower chine 31. The lower chine 28 aids in stability of the hull by acting as a "cutting edge" through the water. The lower chine 28 also aids in speed of the hull due to its sharp longitudinal edges which rapidly and precisely release water.

At the top longitudinal portion of the gunnel 20 there is an upper chine 32 consisting of a fore end 34, middle 35 and rear end of upper chine 36. The function of the upper chine 32 is to break the flow of water from the top of the gunnel which facilitate the planing characteristics and increases speed of the hull.

A pair of stabilizing ailerons 40 each consisting of stabilizing fins 38 function to further increase the stability and facilitate steering of the hull. The ailerons 40 are located at the rear outermost end of the concavities.

Figure 2:
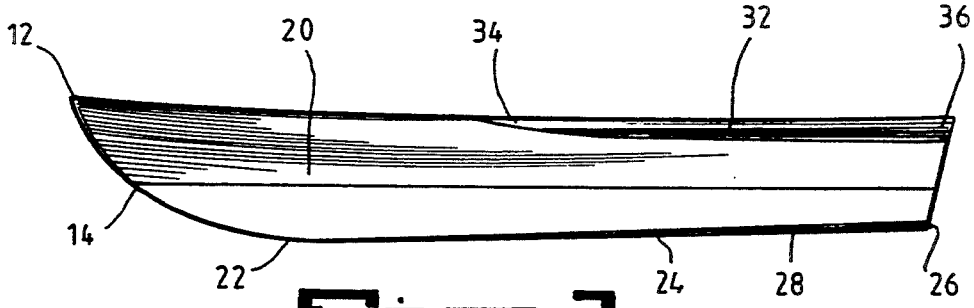
FIG. 2 is a side view of the concave hull.

Now referring to FIG. 2, the hydrodynamically designed hull is streamlined in its appearance. The bow 12 of the hull first engages the water and waves commencing the slicing action of the hull. After the initial engagement of the hull bow 12, the bottom of the bow 14 secondly engages the water which begins to part the water due to the convex shape of the hull between the bow 12 and the lower bow 14. After the first parting or slicing of the water occurs, the water travels downwardly on the gunnel 20 of the hull and the water firstly begins to be released when it engages the fore end of the upper chine 34, hence, travelling laterally down the upper chine 32, the middle chine 35 and thus, finally being cleanly released at the rear end of the upper chine 36.

Hull 10 may be manufactured from any of a group of material such as fiberglass, carbon-graphite, polyester resins, epoxy resins, plastic, aluminum, steel and metal alloy composite.

It will be understood that each of the elements described above, or two or more together, may also find a useful application in other types of constructions differing from the type described above.

While the invention has been illustrated and described as embodied in an aquatic planing hull, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A hydrodynamically designed hull consisting of:

a) a plurality of concave channels, which function to create hydrodynamic lift while channeling water down a longitudinal axis of said concave channels;

b) a central V-shaped channel tapered at both distal ends interspersed between each pair of the concave channels which functions to divide and equalize the forces on both sides of the concave channels; and c) an obtusely angled chine rail located longitudinally at the outermost position of the concave channels functioning to minimize the impedance of water release from the concavities.

2. A hydrodynamically designed hull as described in claim 1, wherein said hull is manufactured from a group of materials such as fiberglass, carbon-graphite, polyester resins, epoxy resins, plastic, aluminum, steel and metal alloy composite.

3. A hydrodynamically designed hull as described in claim 1, wherein said V-shaped channel is composed of equal obtuse angles from said hull surface functioning to channel entrapped water increasing lateral stability through a reverse like skeg arrangement.

* * * * *